United States Patent [19]

Tamaki

[11] 4,308,609

[45] Dec. 29, 1981

[54] POWER SUPPLY DEVICE WITH VOLTAGE DROPPING MEANS

[75] Inventor: Nobuo Tamaki, Murayama, Japan

[73] Assignee: Casio Computer Co., Ltd., Tokyo, Japan

[21] Appl. No.: 100,208

[22] Filed: Dec. 4, 1979

[51] Int. Cl.[3] ..... G04G 1/00

[52] U.S. Cl. ..... 368/204; 320/13; 363/62

[58] Field of Search ..... 363/62; 368/203–205; 307/109, 110; 320/13, 40; 323/15

[56] References Cited

U.S. PATENT DOCUMENTS 3,898,790 8/1975 Takamune ..... 368/204

3,975,670 8/1976 McDermott ..... 323/15

*Primary Examiner*—William H. Beha, Jr.

*Attorney, Agent, or Firm*—Frishauf, Holtz, Goodman & Woodward

[57] ABSTRACT

A power supply system for an electronic device having a battery power source, a logic circuit, a voltage dropping circuit which drops the voltage of the battery power source to produce a dropped voltage, and a load circuit to drop the output voltage of the battery power source comprises a voltage switch circuit for supplying selectively the output voltage from the power source and the dropped voltage from the voltage dropping circuit to the logic circuit as a drive voltage. In the system, the logic circuit is usually operated by the output voltage from the dropping voltage circuit. When the load circuit operates, it is operated by the output voltage from the battery power source.

16 Claims, 4 Drawing Figures

POWER SUPPLY DEVICE WITH VOLTAGE DROPPING MEANS

BACKGROUND OF THE INVENTION

The invention relates to a power supply device for an electronic calculator or timekeeping device using a battery as a power source, such as a desk-top type calculator and a wristwatch.

The electronic device using a battery as the power source, for example, a wristwatch, uses a lithium battery with the battery voltage (about 3 V) two times as high as the conventional one. The output voltage of the lithium battery is dropped to a proper voltage and the related electronic circuit is driven by the dropped voltage. In this way, the lifetime of the battery is prolonged and the battery replacing work is saved.

To be more specific, in this type electronic timepiece, 3 V of a lithium battery is dropped to 1.5 V, for example, by a voltage drop circuit. The dropped voltage is supplied to a logic circuit including an oscillator, a frequency divider and a time counting circuit for producing hour data. The hour data outputted from the logic circuit is visualized by a display unit using, for example, liquid crystal elements.

Generally, this type device has a lamp circuit to display the time at night and a sounding device to sound an alarm. The load circuit of those devices are directly coupled with the lithium battery as a drive power source of the logic circuit, in order to obtain more effective time display and alarm sounding.

As described above, in this type of timepiece, the logic circuit is driven by the dropped 1.5 V voltage, so that the lifetime of the battery is two times that of the battery when the logic circuit is driven by the 3 V power source not dropped, if the power loss arising from the voltage drop is not considered. In this point, this power supply system is excellent.

In this power supply system, the voltage to be applied as a drive voltage to the logic circuit is formed by dropping the voltage from the lithium battery by a voltage drop circuit. If the voltage of the lithium battery drops, the dropped voltage from the voltage drop circuit also drops, as a matter of course. This causes various troubles, such as stopping of oscillation of the oscillator and an erroneous operation in the frequency divider and the counter. When the lamp circuit is driven by a switch to energize the lamp, a large amount of current flows therethrough to considerably drop the output voltage of the lithium power source, resulting in the above-mentioned troubles. A great voltage drop also occurs when the sounding device such as a buzzer is driven.

The power consumption by the voltage drop circuit is utterly useless. The voltage drop oscillator for dropping the voltage of the battery is indispensable for the power supply system as mentioned above. The voltage drop by this circuit is not negligible.

Accordingly, an object of the invention is to provide a power supply system which can drop voltage with low power consumption and prevent the logic circuit from stopping or erroneously operating when the power source voltage drops.

SUMMARY OF THE INVENTION

To achieve the above object, there is provided a power supply device with voltage dropping means comprising a battery power source, voltage dropping means for dropping the output voltage of the battery power source, logic circuit means to which a dropped voltage outputted from the voltage dropping means is applied as a drive voltage, and supplied voltage control means which supplies the output voltage of the battery power source to the logic circuit means when the output voltage of the battery power source drops.

With such a construction, the power supply device of the present invention drives the electronic device with low power consumption. Further, when the battery voltage drops due to the driving of a heavy load such as an illumination lamp, a variation of the drive voltage of the load circuit is restrained within a given range to reliably prevent erroneous operation and a stoppage of the circuit operation.

DETAILED DESCRIPTION

Figure 1:
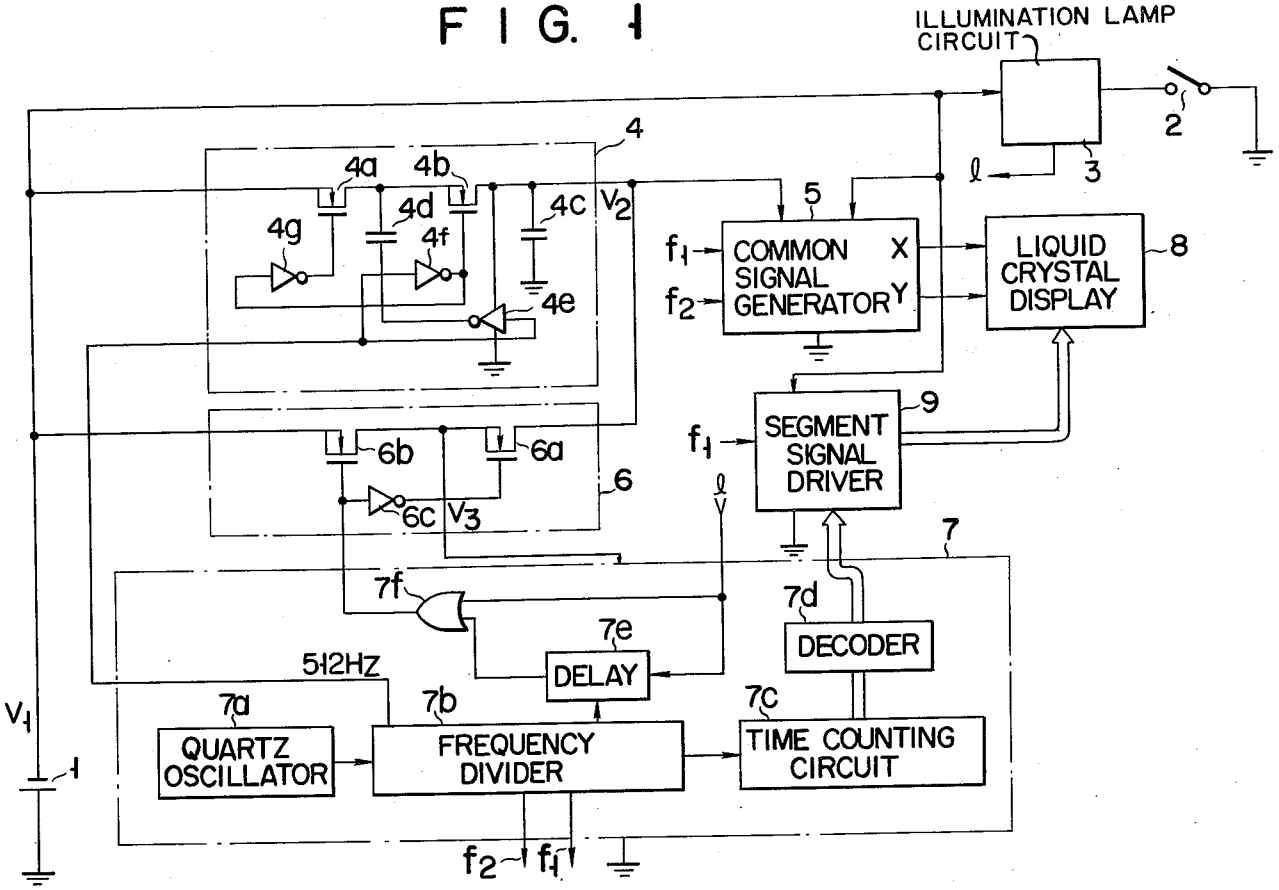
FIG. 1 illustrates a circuit diagram of a power supply system for an electronic wristwatch which is an embodiment of the invention.

In FIG. 1 illustrating a power supply system of an electronic wristwatch, the output voltage V1 of a lithium battery 1 is supplied to a load circuit such as an illumination lamp circuit 3 which provides a signal l with high level when a lamp switch 2 is closed or when a lamp is lit. The output voltage V1 is also connected to the source of an N-channel transistor **4*a* (referred to as a transistor). The output from the drain of the transistor 4*a* is applied through the source of a transistor 4*b* and the drain with a capacitance 4*c* to a common signal generating circuit 5 to be described later and a voltage switching circuit 6 as a dropped voltage V2. The connection point between the drain of the transistor 4*a* and the source of the transistor 4*b* is connected to the output of an inverter 4*e*, through a capacitor 4*d* with the same capacitance as that of the capacitor 4*c*. The input of the inverter 4*e* is supplied with a clock signal for a voltage drop of 512 Hz from a logic circuit 7 to be described later. When the clock signal of 512 Hz is at its high level, the output of the inverter 4*e* is coupled with a signal with low level, or the voltage V2. When it is at its low level, the output is coupled with a signal of high level, or ground. The clock signal of 512 Hz is applied through an inverter 4*f* to the gate of the transistor 4*b* and through an inverter 4*g* to the gate of the transistor 4*a*. The common signal generating circuit 5 supplies common signals X and Y to two common electrodes (not shown) of a liquid display unit 8. The common signal generating circuit 5 is supplied with three reference voltages, the output voltage V1 from the lithium battery 1, the dropped voltage V2 and ground voltage. The circuit 5 combines signals f1 and f2 with given frequencies, e.g. 32 Hz and 64 Hz, to compose the common signals X and Y having the voltages V1 and V2**, and the ground voltage.

The voltage switching circuit 6 is so arranged that the dropped voltage V2 from a voltage drop circuit 4 is coupled with the drain of a transistor **6*a*, the voltage from the source of the transistor 6*a*** is applied to the logic circuit 7 as a drive voltage V3 and is coupled with the output voltage V1 of the lithium battery 1 through the drain and source of a transistor 6b. The gate of the transistor 6b is supplied with a voltage switch signal from the logic circuit 7. The voltage switch signal is also applied to the gate of the transistor 6a, through an inverter 6c.

The logic circuit 7 frequency-divides an oscillating signal from a crystal oscillating circuit 7a. The clock signal with one second period produced from the frequency divider 7a is counted by a time counter 7c. The hour, minute, and second data produced by the time counter 7c is decoded by a decoder 7d of which the output is applied to a segment signal drive circuit 9 supplied with the voltage V1. The segment signal drive circuit 9 dynamically displays the hour data by the liquid display unit 8. To this end, the circuit 9 is supplied with the signal f1 used to compose the common signals X and Y from the frequency dividing circuit 7b. The frequency dividing circuit 7b supplies the clock signal of 512 Hz as a voltage drop clock signal to the voltage drop circuit 4, and supplies the pulse signal with one second period to a delay circuit 7e receiving the signal l applied from the illumination lamp circuit 3 when the lamp is lit. The output signal from the delay circuit 7e, together with the signal l, is applied to the voltage switch circuit 6 through an OR circuit 7f, as the voltage change voltage.

In the above-described circuit construction, since the clock signal of 512 Hz is not applied to the voltage drop circuit 4, the voltage drop circuit 4 does not operate and thus the logic circuit 7 also does not operate. Under this condition, if the lamp switch 2 is turned on, the illumination lamp circuit 3 produces a signal l of high level which in turn is applied through the OR circuit 7f to the transistor 6b thereby to turn on the transistor 6b. As a result, the output voltage V1 of the lithium battery 1 is applied through the transistor 6b to the logic circuit 7, so that the logic circuit 7 starts its operation and the clock signal of 512 Hz is applied to the voltage drop circuit 4 which in turn produces the dropped voltage V1. Then, when the lamp switch 2 is turned off, the output signal from an OR circuit 7f becomes low in level after a given time lapse while the output signal from the inverter 6c becomes high in level. Accordingly, the dropped voltage V2 is applied to the logic circuit 7 through the transistor 6a. Subsequently, when the lamp circuit 3 is in its non-operating condition, the dropped voltage V2 outputted from the voltage drop circuit 4 is applied through the transistor 6a to the logic circuit as the drive voltage V3. The voltage drop circuit 4 operates such that, when the clock signal of 512 Hz is high at its level, the transistor 4b is OFF while the transistor 4a is ON, and the output of the inverter 4e is coupled with the dropped voltage V2. Through its operation, the capacitors 4c and 4d are connected in series and those capacitances are charged by the voltage V1 of the lithium battery 1. Then, when the clock signal for voltage drop becomes low in level, the transistor 4b is turned on while the transistor 4a is turned off. The inverter is grounded at the output, so that the capacitors 4c and 4d are connected in parallel between the voltage drop output and ground. As a result, the voltages charged in the capacitors 4c and 4d, i.e. the voltage which is half of the voltage V1 of the lithium battery 1, is produced from the parallel capacitors.

Figure 2:
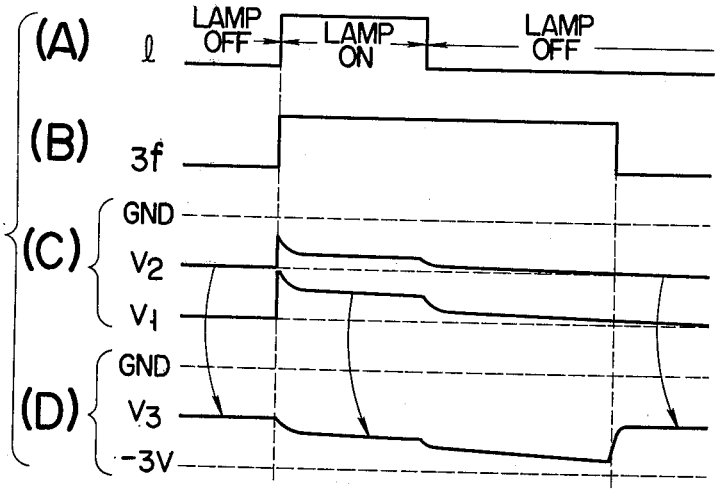
FIG. 2 is a time chart useful in explaining the operation of the power supply system shown on FIG. 2.

When the lamp switch 2 is turned on, large current flows into the lamp, so that the output voltage V1 of the lithium battery 1 drops as shown in FIG. 2(C) and the dropped voltage V2 also greatly reduces. At this time, the lamp circuit 3 produces a signal l of high level which is delayed by the delay circuit 7e by a given time and then is applied to the OR circuit 7f. Upon receipt of the signal, the OR circuit 7f produces a signal as shown in FIG. 2(B). The output signal from the OR circuit 7f turns on the transistor 6b in the voltage switching circuit 6 and at the same time the transistor 6a is turned off. Therefore, the output voltage V1 of the lithium battery 1 is applied to the logic circuit 7 as the drive voltage. When the output signal from the OR circuit 7f becomes low in level, the transistor 6a is turned on while the transistor 6b is turned off, like the case before the lamp is driven. Then, the dropped voltage V2 appears instead of the drive voltage V3. In the above-mentioned embodiment, when the illumination lamp circuit 3 as a load circuit to cause the drop of the output voltage of the battery 1 is driven, the drive voltage of the logic circuit 7 being supplied with the dropped voltage V2 is changed to the output voltage of the battery 1. Therefore, the power supply system of the invention is free from the oscillation stoppage or erroneous operation. If the output voltage V1 from the battery 1 is returned to the dropped voltage V2 immediately after the lighting of the illumination lamp ends, the dropped voltage V2 is still low since the voltage of the battery 1 is insufficiently restored. Accordingly, there is still a possibility that oscillation stoppage and erroneous operation takes place. However, as described above, the embodiment of the invention is so designed that, with provision of the delay circuit 7e, the voltage is restored after the voltage of the lithium battery 1 is sufficiently restored. Therefore, the power supply system of the invention ensures reliable operations of the oscillator and the remaining circuits.

Figure 3:
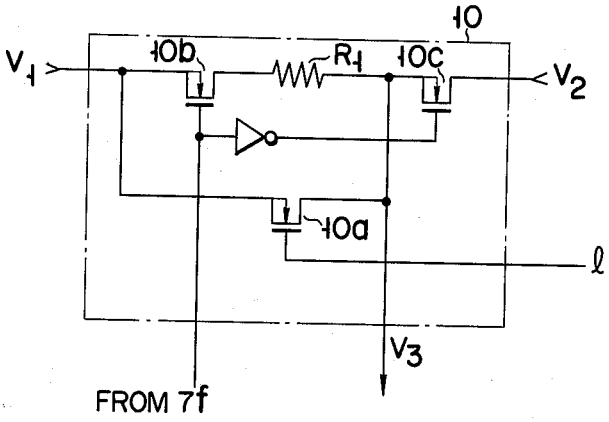
FIG. 3 is a circuit diagram of a voltage switching circuit applied for another embodiment of the invention.
Figure 4:
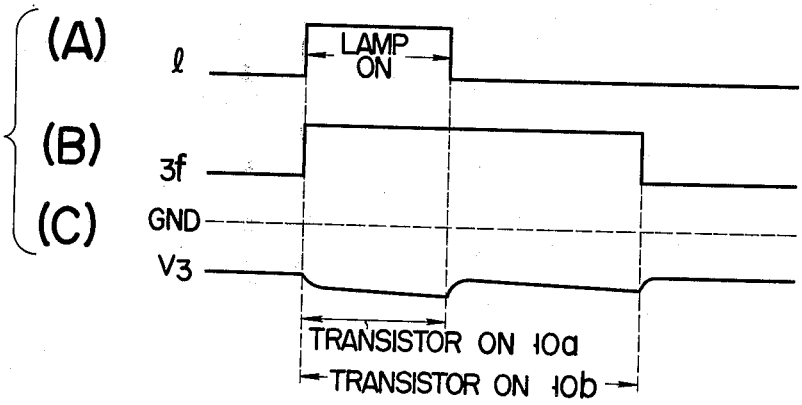
FIG. 4 is a time chart illustrating how the circuit of FIG. 3 operates.

When a variation of the voltage V3 applied to the logic circuit is excessive, the circuit elements of the logic circuit 7 are deteriorated to possibly cause a problem in the circuit. The value of the voltage V1, however, may be reduced by inserting a resistor at the source side of the transistor 6b or increasing the resistance between the gate and the source of the transistor 6b. The voltage switching circuit 10 as shown in FIG. 3 may be used. During a period that the illumination lamp lights, the output voltage V1 is outputted through the transistor 10a and then during a period that the OR circuit 7f produces a signal of high level, the output voltage is produced with a restricted low voltage, through the transistor 10b and the resistor R1. When the output voltage of the OR circuit 7f becomes low in level, the dropped voltage V2 is outputted through the transistor 10c. In this way, the voltage of V3 may be restricted low as shown in FIG. 4(C).

The above embodiment is so designed that the drive voltage to the entire logic circuit 7 is switched. However, this is not essential. For example, the voltage switching may be applied to only the drive voltage to the crystal oscillator 7a as a basic portion of the electronic timepiece.

In addition to the electronic device for electronically and optically displaying the hour by a liquid crystal display, invention is applicable for electronic devices for displaying the hour in analogue manner with the combination of a needle and a step-motor or a desk-top type calculator. Further, any suitable value is allowable for the battery voltage V1 and the dropped voltage V2. The heavy load circuit for dropping the battery voltage is not limited to the illumination lamp but it may be a sounding device such as a buzzer.

What is claimed is:

1. A power supply device with voltage dropping means comprising:

a battery power source;

voltage drop circuit means coupled to said battery power source for dropping the output voltage of said battery power source to obtain a dropped output voltage;

logic circuit means to which said dropped output voltage of said voltage drop circuit means is supplied as a drive power source;

load circuit means which, when operated, applies a load on said battery power source which causes a drop of the output voltage of said battery power source; and voltage switching circuit means responsive to operation of said load circuit means for switchingly supplying the output voltage of said battery power source, as a drive voltage, to said logic circuit means in place of the dropped output voltage from said voltage drop circuit means when said load circuit means is operated.

2. The power supply device of claim 1, wherein said voltage switching circuit means includes means for switchingly supplying the dropped output voltage from said voltage drop circuit means to said logic circuit means in place of the output voltage of said battery power source, a predetermined time after the operation of said load circuit means is completed.

3. The power supply device of claim 1, wherein said logic circuit means includes at least a crystal oscillator circuit, frequency divider means for frequency dividing an oscillation signal from said crystal oscillator circuit, and time count means for counting reference time count signals from said frequency divider means.

4. The power supply device of claim 1, wherein said voltage drop circuit means includes at least two capacitors and means for causing the connection state of said two capacitors to be varied to obtain said dropped output voltage.

5. The power supply device of any one of claims 1, 2, 3 or 4, wherein said voltage switching circuit means includes at least two series-connected transistors, the output voltage of said battery power source being supplied to one of said two transistors and the dropped voltage from said voltage drop circuit being supplied to the other of said two transistors; and means for supplying a voltage at a junction of said two transistors to said logic circuit means.

6. A power supply device with voltage dropping means, comprising:

a battery power source;

a logic circuit means coupled to said battery power source adapted to start its operation upon receipt of the output voltage of said battery power source and including means for generating a clock pulse signal of a predetermined cycle;

voltage drop circuit means coupled to said logic circuit means for dropping the output voltage of said battery power source by said clock pulse signal of a predetermined cycle generated by said logic circuit means and for producing a dropped voltage lower than the output voltage of said battery power source; and voltage switching circuit means for supplying the dropped voltage produced from said said voltage drop circuit means to said logic circuit means in place of the output voltage of said battery power source.

7. The power supply device of claim 6, wherein said logic circuit means includes at least a crystal oscillator circuit and frequency divider means for frequency dividing an oscillation signal from said crystal oscillator circuit, said clock pulse signal being generated by said frequency divider means.

8. The power supply device of claim 6, wherein said voltage drop circuit means includes at least two capacitors and means responsive to said clock pulse signal from said logic circuit means to cause the connection states of said two capacitors to vary as a function of said clock pulse signal to produce said dropped voltage.

9. The power supply device of any one of claims 6, 7 or 8, wherein said voltage switching circuit means includes at least two series-connected transistors, the output voltage of said battery power source being supplied to one of the series-connected transistors and the dropped voltage from said voltage drop circuit means being supplied to the other of said series-connected transistors; and means for supplying a voltage at a junction of said two series-connected transistors to said logic circuit means.

10. A power supply device with voltage dropping means comprising:

a battery power source;

logic circuit means coupled to said battery power source and including at least means for generating a clock signal of a predetermined cycle;

voltage drop circuit means coupled to said logic circuit means for causing a voltage drop to occur by said clock signal from said logic circuit means and for supplying the dropped voltage lower than output voltage of said battery power source, as a drive voltage, to said logic circuit means;

load circuit means which, when operated, applies a load on said battery power source which is sufficiently large as to cause a drop of the output voltage of said battery power source; and voltage switching circuit means responsive to operation of said load circuit means for switchingly supplying the output voltage of said battery power source, as a drive voltage, to said logic circuit means in place of the dropped voltage of said voltage drop circuit means, when said load circuit means is operated.

11. The power supply device of claim 10, wherein said voltage switching circuit means includes means for switchingly supplying the dropped voltage from said voltage drop circuit means to said logic circuit means in place of the output voltage of said battery power source a predetermined time after said load circuit means is operated.

12. A power supply device with voltage dropped means comprising:

a battery power source;

voltage drop circuit means coupled to said battery power source for dropping the output voltage of said battery power source in response to a clock signal of a predetermined cycle and for generating a dropped voltage lower than the output voltage of said battery power source;

logic circuit means at least including means for generating said clock signal of a predetermined cycle which is supplied to said voltage drop circuit means;

external operation switch means provided to start an operation of said logic circuit means; and voltage switching circuit means coupled at least to said external operation switch means for supplying the output voltage of said battery power source to said logic circuit means responsive to the operation of said external operation switch means to cause said logic circuit means to produce a clock signal of a predetermined cycle and said voltage drop circuit means to produce said dropped voltage and for supplying said dropped voltage to said logic circuit in place of the output voltage of said battery power source after the operation of said external operation switch means is completed.

13. The power supply device of claim 12, wherein said logic circuit means includes at least a crystal oscillator circuit, frequency divider means for frequency dividing an oscillation signal from said crystal oscillator circuit, and time counting means for counting reference time count signals from the frequency divider means to obtain time date; and wherein said clock signals of a predetermined cycle are generated by said frequency divider means.

14. The power supply device of claim 12, wherein said logic circuit means includes at least time count means for obtaining time data and includes a liquid crystal display unit for displaying the time data obtained by said time count means; and said external operation switch means comprises a drive switch for an illumination lamp for illuminating said liquid crystal display unit.

15. The power supply device of any one of claims 12, 13 or 14, wherein said voltage drop circuit means includes at least two capacitors and means responsive to said clock signal to cause the connection states of said two capacitors to vary as a function of said clock signal to produce said dropped voltage.

16. The power supply device of any one of claims 12, 13 or 14, wherein said voltage switching circuit means includes at least two series-connected transistors, the output voltage of said battery power source being supplied to one of said two transistors and the dropped voltage from said voltage drop circuit being supplied to the other of said two transistors; and means for supplying a voltage at a junction of said two transistors to said logic circuit means.

* * * * *